United States Patent [19]

Yancey

[11] 3,943,397

[45] Mar. 9, 1976

[54] UNITIZED THEATER LIGHTING SYSTEM MAIN POWER UNIT

[76] Inventor: Leroy D. Yancey, 1834 S. Oakmont Drive, Bountiful, Utah 84010

[22] Filed: Feb. 24, 1975

[21] Appl. No.: 552,555

Related U.S. Application Data

[63] Continuation-in-part of Ser. No. 423,073, Dec. 10, 1973, abandoned.

[52] U.S. Cl. ..... 315/317; 315/320; 317/100; 317/101 CB; 317/101 DH; 317/117; 317/120

[51] Int. Cl.[2] ..... H05B 37/00

[58] Field of Search ..... 315/313, 316–320; 317/100, 101 CB, 101 D, 101 DH, 117, 120

[56] References Cited

FOREIGN PATENTS OR APPLICATIONS 761,092 6/1967 Canada ..... 315/316

*Primary Examiner*—James B. Mullins
*Attorney, Agent, or Firm*—Trask & Britt

[57] ABSTRACT

In a theater lighting system that regulates the luminescence of incandescent lamps, a main power unit is constructed of unitized components which include a chassis, main power apparatus drawers, electronic control circuit boards, a power bus unit and equipment rack. The drawers and boards are removably located in separate sections of the equipment cabinet remote from each other. The operator's console contains a plurality of sources of control signals which are supplied to the equipment cabinet to control the output power of main power apparatus. Main power apparatus of different power ratings are interchangeably usable in each such system.

13 Claims, 15 Drawing Figures

UTILIZED THEATER LIGHTING SYSTEM MAIN POWER UNIT

RELATED DISCLOSURES

This application is a continuation-in-part of application Ser. No. 423,073, filed Dec. 10, 1973, and now abandoned, which was copending with application Ser. No. 386,039 for "Solid State Electronic Stage Lighting Control Circuit", filed Aug. 6, 1973, now U.S. Pat. No. 3,835,349, issued Sept. 10, 1974, the disclosure of which is hereby incorporated by reference.

BACKGROUND OF THE INVENTION

1. Field

This invention relates to theater (stage) lighting systems which regulate the luminescence of incandescent lamps. Specifically, this invention provides for a unitized main power unit for use in a theater lighting system wherein the cabinet includes a chassis, main power apparatus drawers, control circuit boards, a power bus unit and equipment rack.

2. State of the Art

A typical theater (stage) lighting system of today is a combination of electrical and electronic components and circuitry. Many of these systems employ solid state electronic circuitry to control the conductivity and, in turn, the power passed by controllable solid state main power apparatus (e.g., silicon-controlled rectifiers (SCR's) and TRIACS) to the incandescent lamps. Normally a plurality of external signal sources supply control signals to a corresponding plurality of control circuits. The control circuits in turn control the conductivity of a corresponding plurality of main power apparatus. The main power apparatus typically supply the power (as regulated by the control circuit) to a selectably variable number of lamps through a patch panel.

Conventionally, each system is made to order (physically and electrically) for a specific application. As constructed, these systems often include a control console which contains the external signal sources and one or more equipment cabinets which contain a plurality of drawers. The drawers, which are removably installed in a chassis contain the control circuitry and the main power apparatus.

The systems as above described are quite costly and difficult to maintain. The main power apparatus generate an appreciable amount of heat which adversely affects the other components and circuitry located in each drawer. Heat induced failures are not uncommon. Notably the drawers are very costly as they contain many components and much circuitry. Thus, many users are inhibited by cost alone from procuring a readily available spare or from acquiring a replacement after failure. In many cases replacement drawers are totally unavailable because the drawers for the particular system were tailor made and have no interchangable counterpart. Similarly, intermediate distributors are prohibited from stocking replacement drawers because of their singular application and/or high cost.

Moreover, it is quite difficult to repair a failed drawer. First, the components and circuitry are fixedly secured (e.g., hard wired) in the drawer, making replacement of defective components difficult. Secondly, sophisticated trouble shooting, often with the drawer energized (hazardous), is needed to diagnose the failure and pinpoint the defect. Accordingly the costly services of a highly skilled technician are needed. Returning a defective drawer to its manufacturer for repair is a feasible alternative; but this too is costly and the time delay may frequently be intolerable by the very nature of the theater business itself.

Many of the dimming systems above described also include direct on-off (non-dim) circuits. A few non-dim circuits are normally provided in each dimming system. These circuits are included because they provide operational flexibility. The non-dim circuits normally include an on-off device in series with a main power apparatus drawer. The on-off device is normally comprised of mercury contacts and holding relays. The voltge applied to the lamps by a non-dim circuit is generally higher (e.g., about 6 volts) than the maximum voltage available from a dimmed circuit. The result is inconsistent maximum illumination between dimmed and non-dim circuits. Operator confusion and error is a frequent result. Further, the cost of providing a non-dim circuit is quite high. An expensive main power apparatus drawer of the same type and configuration as used elsewhere in the system are normally used. Extensive engineering costs arise from the design work needed to provide the non-dim circuit capability. Also additional costs are incurred in obtaining the extra components (e.g., switches and relays) needed for the non-dim circuit. Additional maintenance costs also arise.

SUMMARY OF THE INVENTION

A unitized main power unit in a theater (stage) lighting system is provided which includes main power apparatus drawers installed in a matrix in a first section of the chassis. Electronic control circuit boards are installed in a control circuit section of the same equipment chassis. The main power apparatus drawers are positioned remote from the control circuits to limit control circuit failures induced by the heat generated by main power components in the drawers. The main power drawers include one or more main power apparatus and are formed to be heat transfer means and connectors. Drawers of differing ratings (i.e., drawers containing one or more main power apparatus of different KVA capacity) are constructed which are interchangably usable in the cabinet by providing a premade connector arrangement adapted for such drawers. Maintenance is facilitated because the drawers and boards are all removably connected in the cabinet and because leads, terminals and connectors are readily accessible. With accessible leads and the use of thyristors, non-dim circuits can be cheaply constructed by shorting the gate signal leads of the thyristors.

A plurality of bus bars are positioned in the chassis with spaced-apart main power connectors positioned along their lengths to form a matrix of connection sites for the main power drawers. The bus bars may be secured to insulator means which extend along the length of the bus bars. The insulator means may in turn be secured to vertical support members which have a plurality of spaced-apart output connectors positioned along their lengths. The output connectors may be conductively connected to an output terminal positioned at one end of the vertical connector member for connection to an external circuit. The vertical connector members may also be secured to horizontal support members to form a removable power bus unit.

An equipment rack is also positioned in the first section of the chassis. It has support members to support the drawers. Control connectors are positioned along the length of the support members to correspond with and connect to control signal input connectors of the drawers. The equipment rack may extend between the first section and second section of the chassis. A circuit board housing may be secured to the rack. A removable unitized equipment rack may be formed by respectively securing the opposite ends of the support members and circuit board housing to two opposite and substantially parallel support members.

In one form of the invention the first section is positioned above the second section. In another, the drawers contain sidewall members having vanes to transfer heat to air passing through the open bottom and top of the drawer.

BRIEF DESCRIPTION OF THE DRAWINGS

In the drawings, which illustrate the best mode presently contemplated for carrying out the invention.

DESCRIPTION OF THE ILLUSTRATED EMBODIMENT

Figure 1:
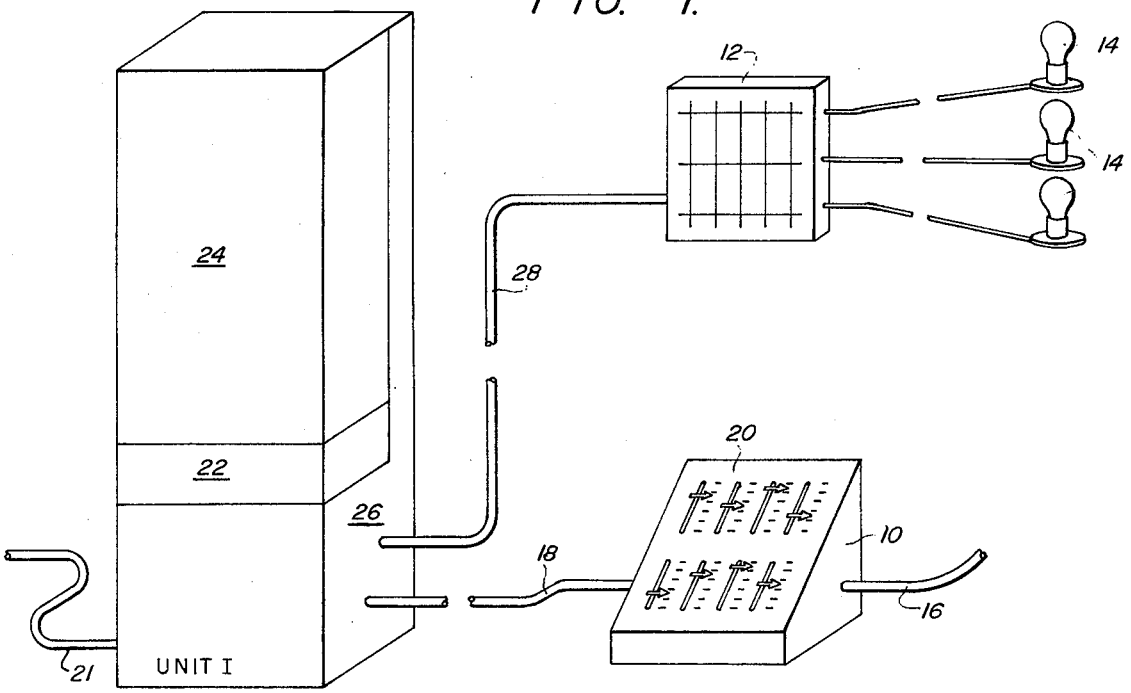
FIG. 1 shows a unitized main power unit of this invention in combination with other elements of a theater lighting system.

FIG. 1 illustrates a main power unit I of this invention in combination with a control console 10, a patch panel 12 and incandescent lamps 14. The control console 10 receives power (e.g., 115v 60hz) via cable 16 and supplies control signals to main power unit I via multiconductor cable 18. The control signals are preferably direct current signals generated by direct current rectifiers in combination with adjustment means (i.e., external signal sources). The adjustment means illustrated are slide potentiometers 20 combined with the rectifiers (not shown) in a generally well known manner. The main power unit I receives main power via cable 21. The control signals are processed in unit I to control the amount of main power supplied to the lamps 14.

The main power unit I may be regarded as being divided into three sections which are a control circuit section 22, a main power apparatus section 24 and a terminal and interconnecting conductor section 26. The patch panel 12, which may be any one of several commercially available units, receives the output of the main power apparatus via cable 28. The panel 12 allows an operator to vary the number of lamps 14 and/or groups of lamps 14 being powered by a particular main power apparatus.

Figure 2:
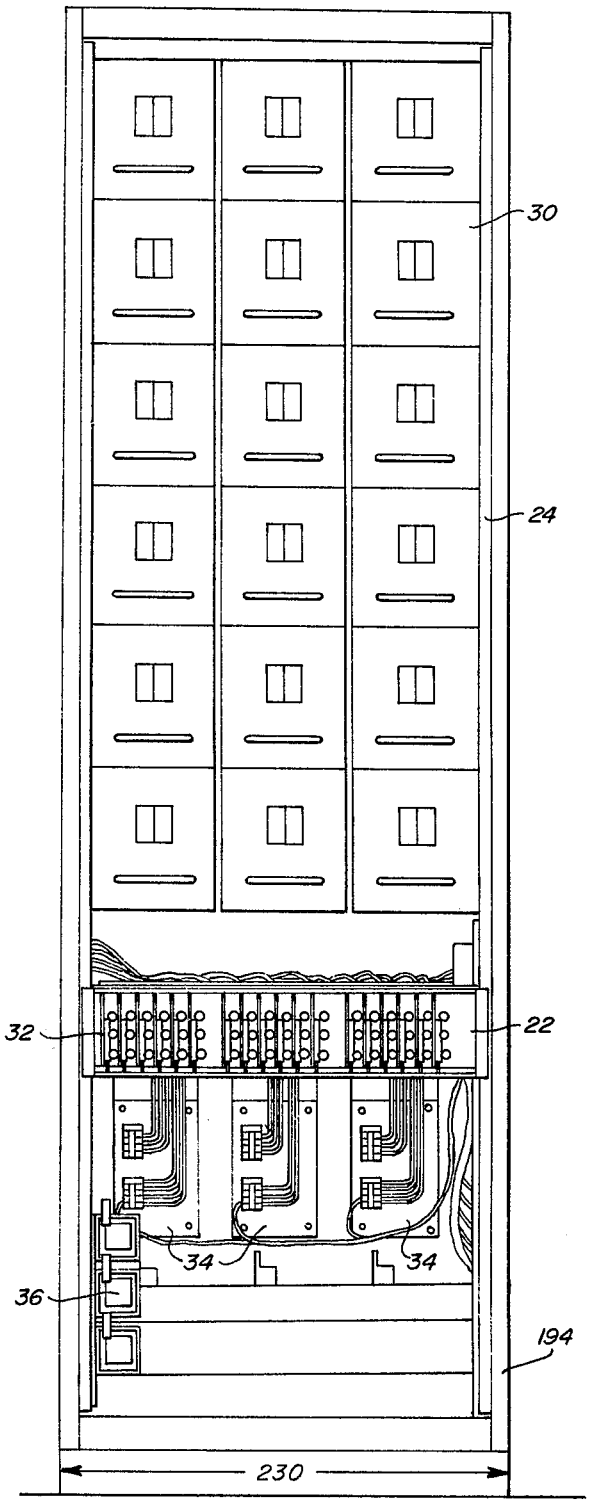
FIG. 2 is a front view of a unitized main power unit of this invention with its front panel (door) removed.

FIG. 2 illustrates the main power unit I of this invention in more detail. As shown, the main power apparatus section 24 is constructed to accept 18 main power drawers 30 in a matrix consisting of three vertical and six horizontal rows. The control circuit section 22 is constructed to accept an equal number (18) of control circuit boards 32. The control circuit boards 32 are constructed as conventional electronic circuit boards in a generally well-known manner. They contain circuits such as those disclosed in U.S. Pat. No. 3,335,318 (Yancey), U.S. Pat. No. 2,920,240 (Macklem) and U.S. Pat. No. 3,835,349 (Yancey). Three vertical connector members 34 are shown extending into the terminal and interconnecting conductor section 26. Also shown are three 24 volt power supplies 36, each of which supply power to six control circuits 32.

In the arrangement shown in FIG. 2, the exact number of drawers 30 and corresponding control circuit boards 32 positioned in the unit I is but a function of the size (dimensions) of the unit I. The unit I as illustrated in FIG. 2 is about 71 inches high, about 26 inches wide and about 22 inches deep. A unit I of this size is preferred over larger or smaller sized cabinets because it is the most flexible and adaptable to a variety of applications. The unit I as shown has sufficient capacity (in the number of drawers 30 and boards 32) to meet the requirements of many, if not most, stage lighting systems. For systems requiring more drawers 30 and boards 32 than available in unit I, additional cabinets I may be provided.

Of note is the positioning of the control circuit boards 32. Specifically they are positioned below the drawers 30. In such a position the control circuits, which are more heat sensitive and prone to heat induced failure, are removed and in effect insulated from the substantial amounts of heat generated by the main power components in the drawers 30. The boards 32 could also be located horizontally adjacent to the drawers 30. Such an arrangement would provide many of the advantages arising from the illustrated positioning (i.e., boards 32 below drawers 30. But the illustrated positioning is preferred because it is simple to construct and because it permits use of vertical connector members 34 and a power bus section as more fully discussed hereinafter.

Figure 3:
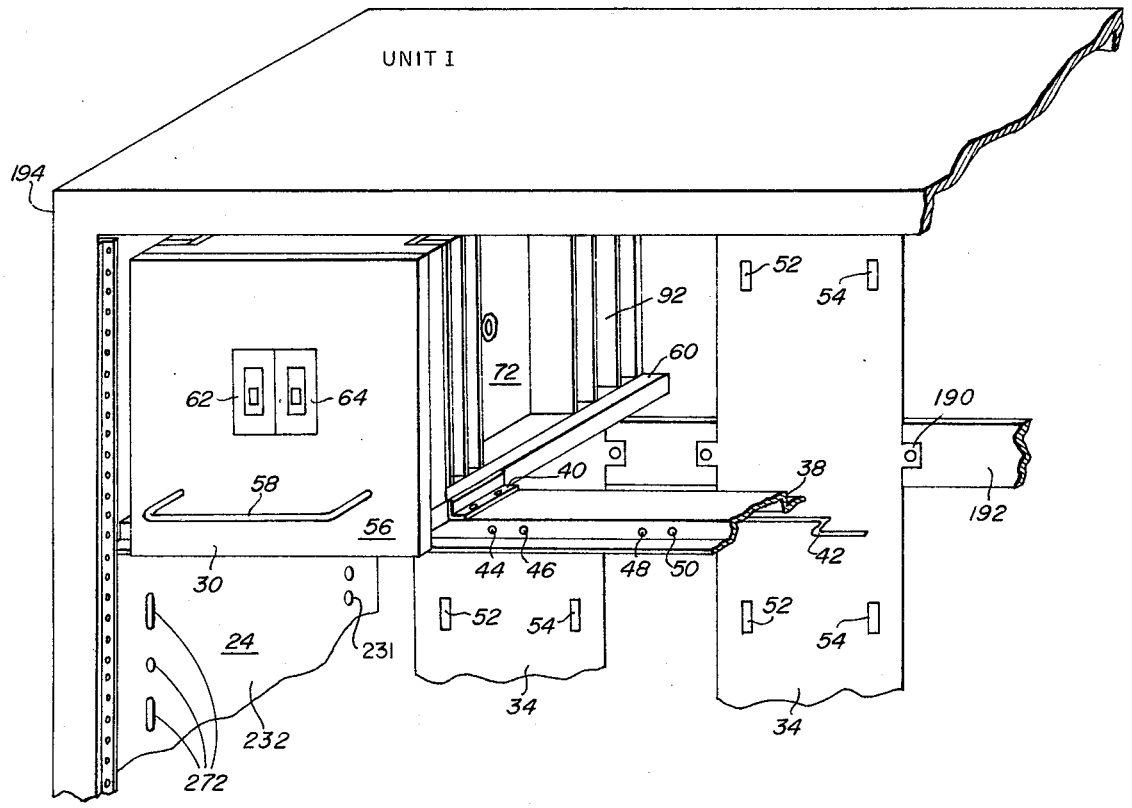
FIG. 3 is a cut-away perspective view of the upper portion of the unit of FIG. 2.

A perspective cut-away of the upper portion of the main power apparatus section 24 is provided in FIG. 3. As illustrated, a drawer 30 is supported in its matrix position by support member 38. Guide piece 40 is fixed to the member 38 and operates to guide and fix the position of drawer 30. Conductors 42 are secured under and to the support member 38, and supply the output of a control circuit 32 to control connectors 44, 46, 48, 50 fixedly secured in the support member 38.

The connectors 44, 46, 48, 50 are juxtaposed opposite corresponding and cooperative control signal input connectors (not shown) of the drawer 30. A variety of male-female connector arrangements are available for this purpose. The support member 38 is positioned with respect to the drawer 30 so that the electrical connection to connectors 44, 46, 48, 50 is made when the drawer 30 is fully inserted in its matrix position. As more fully described hereinafter, the drawers 30 also electrically connect with connectors 52, 54 positioned on the vertical connector member 34.

It should be noted that the support member 38 is flanged and 'D' shaped in section. It is also preferably made of a fiberglass material. The flanged D shape allows for more than adequate structural strength notwithstanding use of fiberglass material. Also such shape permits the drawers 30 to be inserted and removed from the cabinet I without any interference from or hazard to (e.g., chaffing) wires 42, because the wires 42 are fixed within and protected by the D portion of the member 38. Also the potential for electrical shorts in the main power unit I is reduced because fiberglass is an insulator (non-conductor).

The main power drawer 30 of FIG. 3 contains a main power apparatus capable of delivering up to about 6 kilo-volt-amps (KVA). Drawer 30 is illustrated more fully in FIGS. 4 and 5. It includes a front facing panel 56, a handle 58 and base track 60. Also included are circuit breakers 62, 64, SCR's 66, 68, input vane base 70, output vane base 72 and an insulating separator 74. The vane bases 70, 72 act as the drawer 30 side wall members. Main power is supplied to the drawer 30 from the main power bus 76 through a filter-reactor 78. The main power bus bar 76 is mounted to a D shaped vertical insulating member 80 which is mounted to vertical support member 34. The bus bar 76 may also be mounted directly to the support member 34. The power from the reactor 78 passes through clip connector 52 and knife connector 82 to input vane base 70. The output of drawer 30 is supplied via output vane base 72, through knife connector 84, clip connector 54 and ring connector 86, to output power conductor 88.

Figure 5:
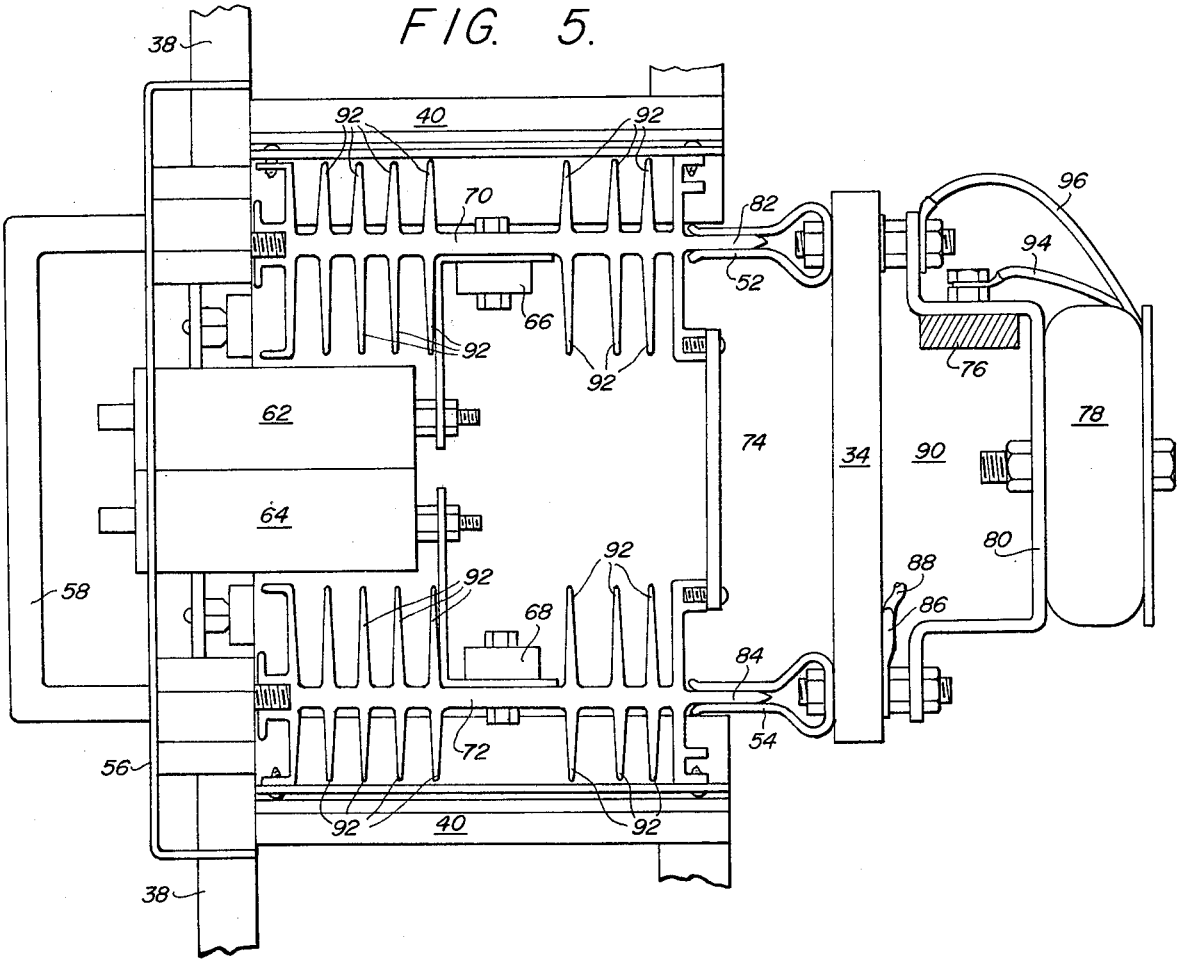
FIG. 5 is a top view of the main power apparatus drawer of FIG. 4.

As best shown in FIG. 5, the vertical insulating member 80 is flanged and D shaped in section. It is preferably constructed of a fiberglass material which provides adequate structural strength while minimizing the potential for electrical shorts. The D shape of member 80 creates a space 90 between support member 34 and the insulating member 80. The bus bar 76 is positioned within the space 90 to minimize the shock hazard during maintenance and cleaning operations. The space 90 also acts as a wire run for the output conductors 88 of drawers 30.

The insulating separator 74 is preferably made of melamine, fiberglass, or some other suitable structurally strong insulating material. It provides structural strength to the drawer 30.

The SCR's 66, 68 are mounted in direct physical contact with vane bases 70, 72. Electrical contact is thereby effected while providing a surface contact betwen the SCR's 66, 68 and vane bases 70, 72 to transfer the heat generated by the SCR's 66, 68 to their respective vane bases 70, 72.

Figure 4:
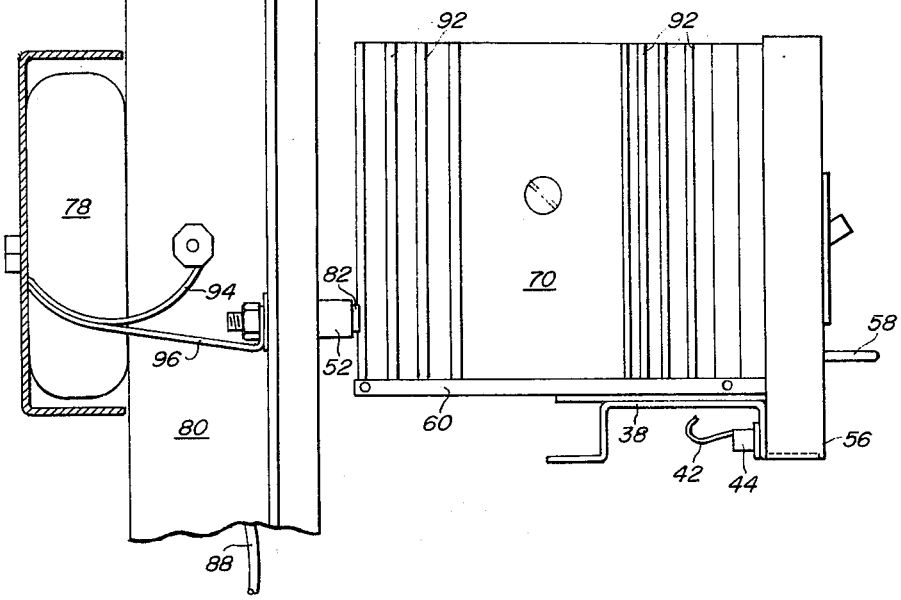
FIG. 4 is a side view of a main power apparatus drawer of the type installed in the unit of FIG. 2.

As illustrated in FIGS. 4 and 5, a plurality of heat dissipating vanes 92 are part of the structure of input vane base 70 and output vane base 72. Air in contact with the vanes 92 is heated and rises. The result is, in effect, an air cooled heat exchanger. A blower or fan (not shown) may be provided if desired near the bottom of unit I to blow air up into the main power drawer section 24 to improve heat transfer. The vanes 92 and vane bases 70, 72 are preferably constructed of aluminum. Aluminum is an acceptable electrical conductor and an excellent heat conductor. Thus, the electrical conductor and heat dissipation functions are performed by the same structure (i.e., vanes 92 and vane bases 70, 72). Also, the vanes 92 and vane bases 70, 72 act as the side wall members of drawer 30. They are electrically insulated from other structural members of the drawer 30. Further, the vane bases 70, 72 are formed with knife connectors 82, 84 to mate with clip connectors 52, 54. Thus the combined structure of the vanes 92 and vane bases 70, 72 perform many functions. Manufacturing of the drawer 30 is thereby simplified and costs significantly reduced. That is, the use of a single component which performs a multitude of functions eliminates the need to purchase and to install individual components to perform those functions.

Figure 6:
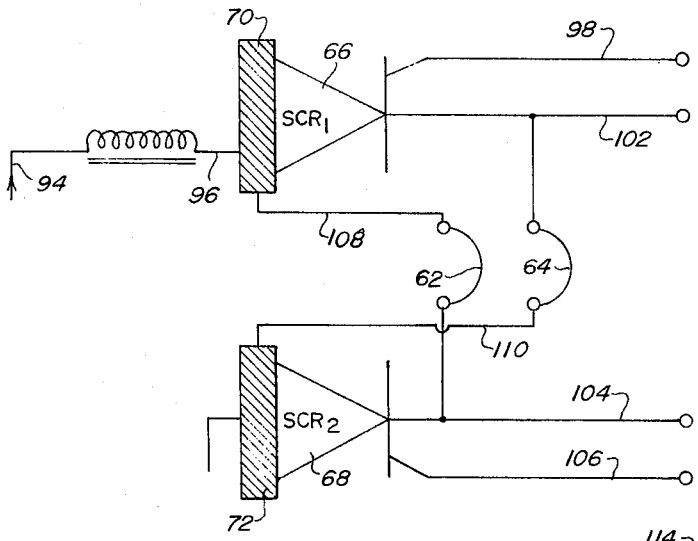
FIG. 6 is an electronic circuit diagram of the main power apparatus drawer of FIG. 5.

FIG. 6 depicts the electrical circuit diagram of the main power apparatus in drawer 30. The main power apparatus utilized two thyristors (e.g., SCR's) in the inverse parallel connection. Power is received by the filter reactor 78 from the main power bus 76 via conductor 94. Power is then supplied to the input vane base 70 through conductor 96 and connectors 52, 82 (not shown). SCR 66 is conductively connected to vane base 70. The SCR gate signal is received from connector 44 (FIG. 3) and supplied to SCR 66 via conductor 98. The SCR cathode signal is received from connector 46 (FIG. 3) and supplied to SCR 66 via conductor 102. Gate and cathode signals for SCR 68 are received from connectors 48 and 50 via conductors 104 and 106 respectively. The anode-cathode cross-connections 108 and 110 respectively contain circuit breakers 62 and 64 in series. The circuit breakers 62, 64 provide overload protection and permit various circuits to be selectively de-energized to facilitate maintenance. SCR 68 is conductively connected to output vane base 72. The main power apparatus output signal, which is in this case the drawer 30 output signal, is supplied from the output vane base 72 to output conductor 88 via connectors 54 and 84 (not shown).

Figure 7:
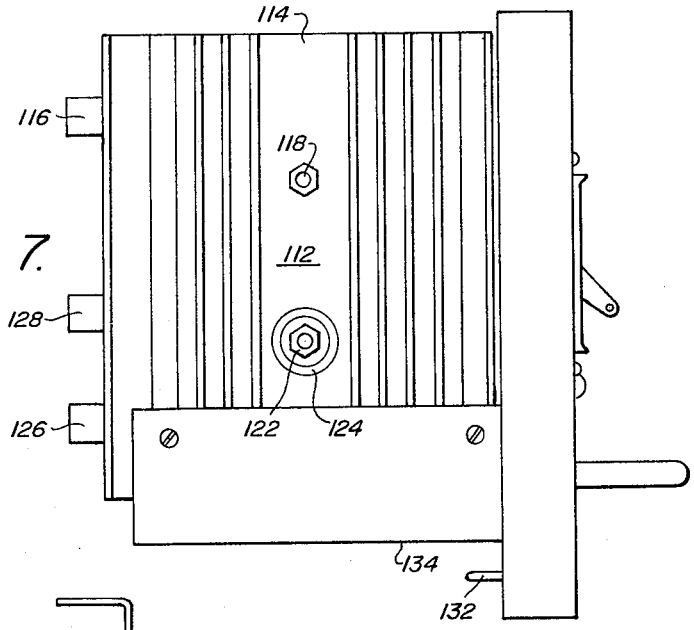
FIG. 7 is a side view of a main power apparatus drawer containing two main power apparatus.
Figure 8:
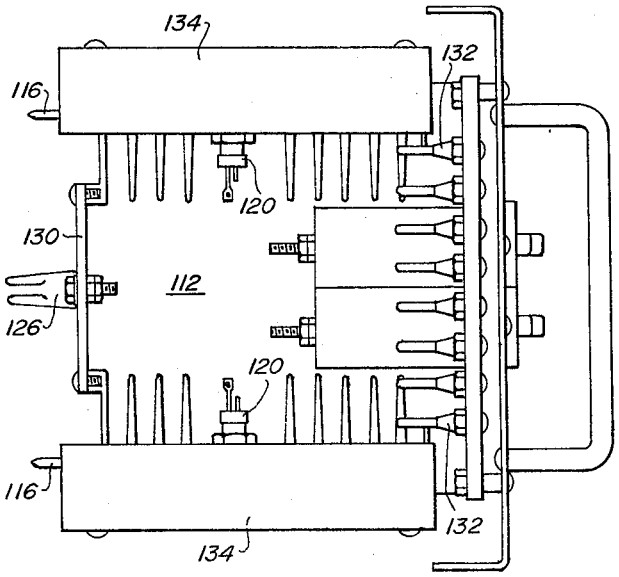
FIG. 8 is a bottom view of the main power apparatus drawer of FIG. 7.

FIGS. 7 and 8 illustrate a main power drawer 112 containing two main power apparatus each capable of delivering up to about 4 KVA. The drawer 112 is designed to fit in a matrix position just as drawer 30 (FIG. 3), and thus is substantially identical to drawer 30 in dimension. The drawer 112 is also physically constructed of components substantially identical to those of drawer 30. However, provisions are made to physically and electrically accommodate two main power apparatus. Electrical power is supplied to each vane base 114 of drawer 112 through knife connectors 116. The upper SCR is directly mounted to base 114 to effect electrical connection and permit thermal conduction between the SCR and base 114. The lower SCR 120 is mounted to base 114 by nut 122. Thermally conductive electrical insulating discs 124 electrically isolate the SCR 120 from the base 114. The output of each main power apparatus is supplied to two electrical connectors 126, 128 which are mounted to insulating separator 130. Eight control signal connectors 132 are provided to receive required control signals for both SCR's of each main power apparatus. The illustrated base track 134 of drawer 112 is different from base track 60 of drawer 30 (FIGS. 3 and 4) to illustrate an acceptable alternate. The base track 134 is "L" shaped in section. It provides added structural strength to the drawer 112 and is cheaper to manufacture.

Figure 9:
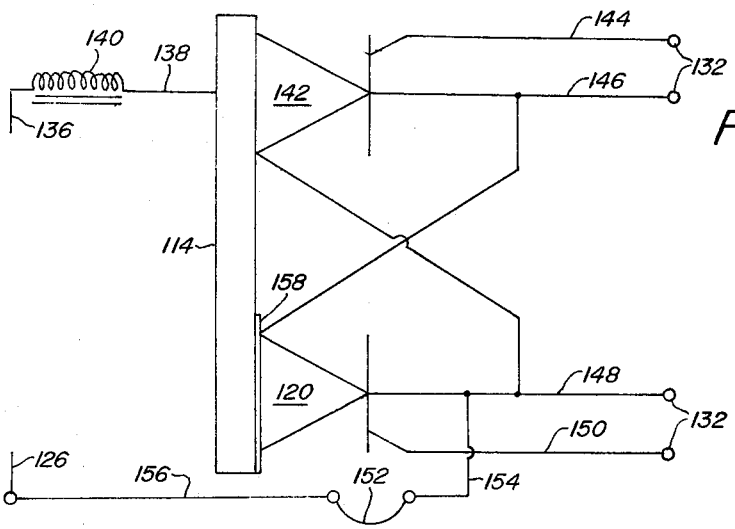
FIG. 9 is an electronic circuit diagram of one of the main power apparatus in the drawer of FIGS. 7 and 8.

FIG. 9 is a circuit diagram of one main power apparatus of drawer 112. Power is supplied to vane base 114 via conductors 136 and 138 and filter reactor 140. Upper SCR 142 and lower SCR 120 receive their respective gate and cathode signals from connectors 132 via conductors 144, 146, 148 and 150. The apparatus output is supplied via circuit breaker 152 and conductors 154 and 156 to connector 126 (or 128). The lower SCR 120 is shown as electrically insulated from base 114 by a thermally conductive electrical insulator 158.

Figure 10:
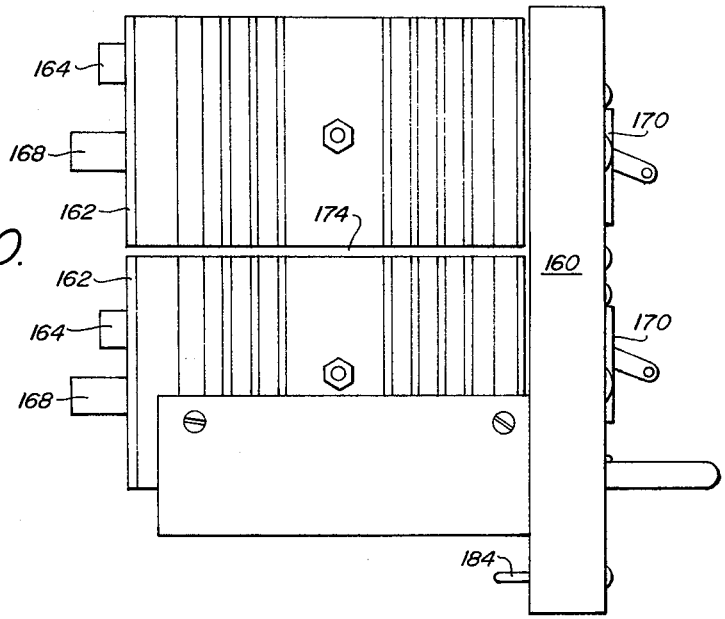
FIG. 10 is a main power apparatus drawer containing four main power apparatus.
Figure 11:
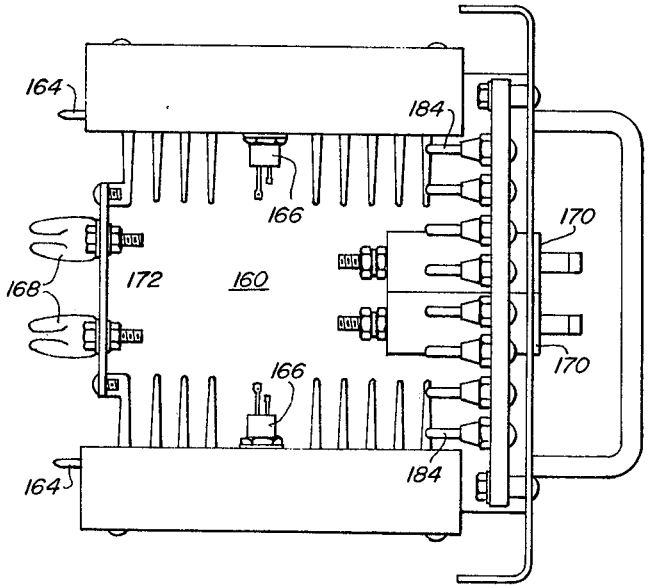
FIG. 11 is a bottom view of the main power apparatus drawer of FIG. 10.
Figure 12:
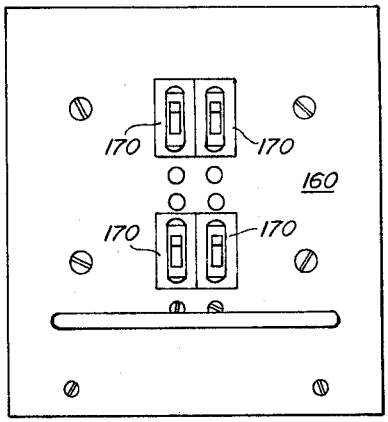
FIG. 12 is a front view of the main power apparatus drawer of FIG. 10.

FIGS. 10, 11 and 12 illustrate a main power drawer 160 containing four main power apparatus each capable of delivering up to about 2 KVA. The drawer 160 differs from drawers 30 and 112 in that it must physically accommodate four main power apparatus. Electrical power is supplied to four separate vane bases 162 through knife connectors 164. The vane bases 162 supply power to their respective TRIACS 166 which are mounted to bases 162 in a manner to effect electrical and thermal conduction. Output power is supplied to four output connectors 168. Four circuit breakers 170, one per main power apparatus, are also supplied.

The vanes bases 162 of drawer 160 are preferably manufactured by simply cutting a vane base 70, 72 of drawer 30 (FIG. 5) or a vane base 114 of drawer 112 (FIG. 7) horizontally in half. The insulating separator 172 provides needed structural support to maintain the gap 174 existing between two vertically adjacent bases 162.

Figure 13:
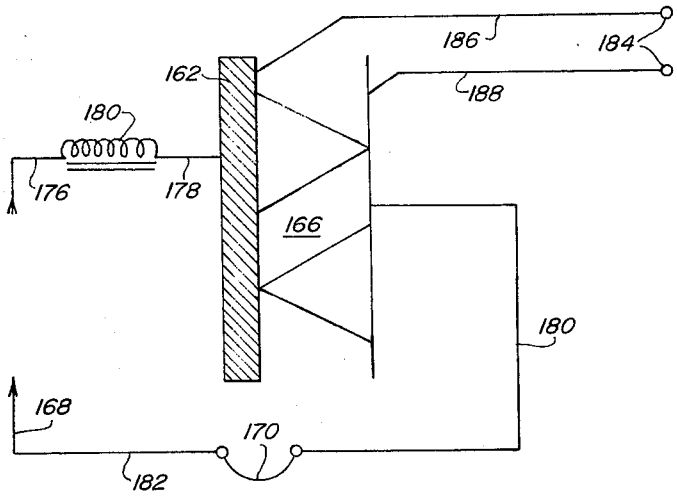
FIG. 13 is an electronic circuit diagram of one main power apparatus in the main power apparatus drawer of FIGS. 10, 11, and 12.

FIG. 13 is a circuit diagram of one main power apparatus in drawer 160. Power is supplied to vane base 162 via conductors 176, 178 and filter reactor 180. The TRIAC 166 receives its power from the base 162 and supplies an output to connector 168 via conductors 180, 182 and circuit breaker 70. TRIAC control signals are received from connectors 184 via conductors 186 and 188.

FIG. 5 shows a single filter reactor 78 for use with drawer 30 having a single main power apparatus. For drawer 112 two filter reactors 140 are required. And for drawer 160, four filter reactors 180 are required. For drawer 112 the filter reactors 140 are placed vertically one above the other and mounted to member 80 in a manner similar to that of filter reactor 78. For drawer 160, the four reactors 180 are mounted in groups of two. The two reactors 180 of each group are mounted adjacent to each other in the same horizontal plane, one behind the other. One group is mounted vertically above the other. Electrical connections are effected in a manner similar to that depicted in FIG. 5.

Figure 14:
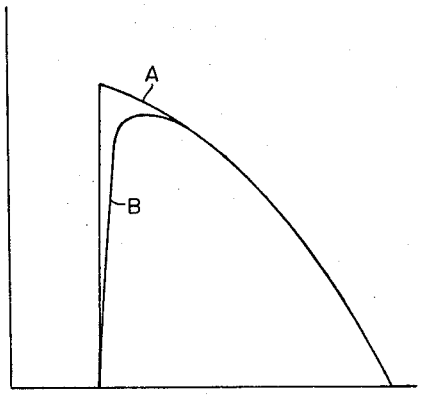
FIG. 14 is a signal diagram showing a power signal into a filter reactor and a power out signal from a filter reactor.

FIG. 14 illustrates the effect of a filter reactor 78. The vertical axis of the graph of FIG. 14 is voltage; and the horizontal axis is time. Input main power to a main power apparatus is preferably 120 volt 60 Hz (single phase sine wave) power. Signal A represents dimmed power (sine wave) at 90° conduction with no filter reactor 78 in circuit. Signal B represents dimmed power at 90° conduction with a filter reactor 78 in circuit. By comparing signal A and B, it can be seen that the filter reactor 78 lowers the initial peak voltage and reduces the rate of increase of voltage. Thus the possibility of voltage-shock damage to the SCR's is reduced. Also, radio frequency (RF) harmonics are eliminated, reducing possible RF interference with other nearby devices (e.g., an audio amplifier system). Physical vibration of the filaments of the lamps 14 is also reduced, eliminating audible noise which may interfere with stage activities.

As presently configured, the illustrated drawer 30 of FIGS. 4 and 5 is adapted to accommodate a pair of thyristors 66, 68 in a single main power apparatus capable of delivering up to about 6 KVA. With appropriate modification to the vertical member 34 and support member 38 as more fully discussed below, a drawer 30 having similar structural characteristics (ie., drawers 112 and 160) and containing several main power apparatus with different electrical characteristics (i.e., KVA capacity) may be substituted for the illustrated drawer 30. Main power apparatus having different electrical characteristics (i.e., KVA capacities) are often needed to meet the requirements of specific lighting systems. That is, a smaller sized (KVA rating) apparatus should be used for a lighting system having lighting circuits (i.e., lamp 14 load per main power apparatus) rated substantially less (e.g., 3 KVA) than the 6 KVA available from the apparatus in the illustrated drawer 30. Similarly, a smaller sized apparatus (e.g., 2 KVA) should be used for systems having lighting circuits rated substantially less than 3 KVA.

As shown in FIG. 1, the main power apparatus section 24 is constructed as a matrix providing positions for 18 main power drawers 30 (112 or 160) in three vertical rows and six horizontal rows. A vertical connector member 34 is positioned behind each of the three vertical rows. As best shown in FIGS. 4 and 5, the member 34 serves a variety of functions. Specifically it acts as the mounting board for connectors 52 and 54 and acts as a back stop for drawer 30 (112 or 160). It also serves as the mounting board for insulating member 80 and indirectly for bus 72 and filter reactor 78 (140 or 180). Thus unnecessary structure is eliminated; and, as more fully explained below, a simple replacable unit of components is provided.

Figure 15:
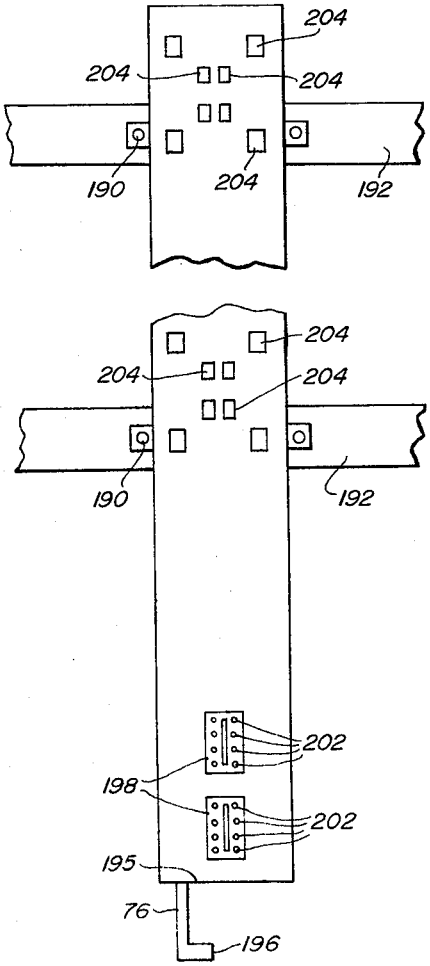
FIG. 15 shows one vertical connector member for use in the unit of FIG. 2.

As can be seen from FIGS. 2 and 3, the vertical connector member 34 illustrated in FIG. 15 extends the length of the main power apparatus section 24 and the control circuit section 22 and into the terminal section 26. Mounting tabs 190 (or other appropriate mounting means) provide for attachment to cross supports 192 which are in turn fixed to the chassis 194 of unit I (FIG. 3). As shown, the main power bus 76 extends below the lower end 195 of member 34, and has a terminal 196 affixed thereto for connection to external main power. Load conductors 88 (FIG. 5) from each matrix position are connected to terminal boards 198 on the side opposite that shown. Load leads 202 are connected to the terminal boards 198 on the side shown in FIG. 6. The leads 202 are further connected to the system load, i.e., lamps 14, through terminals 198 (FIG. 15) and patch panel 12 (FIG. 1).

As stated above, the vertical connector member 34, and the components thereto attached are in effect a simple replacable unit. This effect is achieved by mounting all the components (e.g., vertical insulating member 80 to the vertical connector member 34). Thus a unit (of components) is created which may simply be installed or removed.

Figure 16:
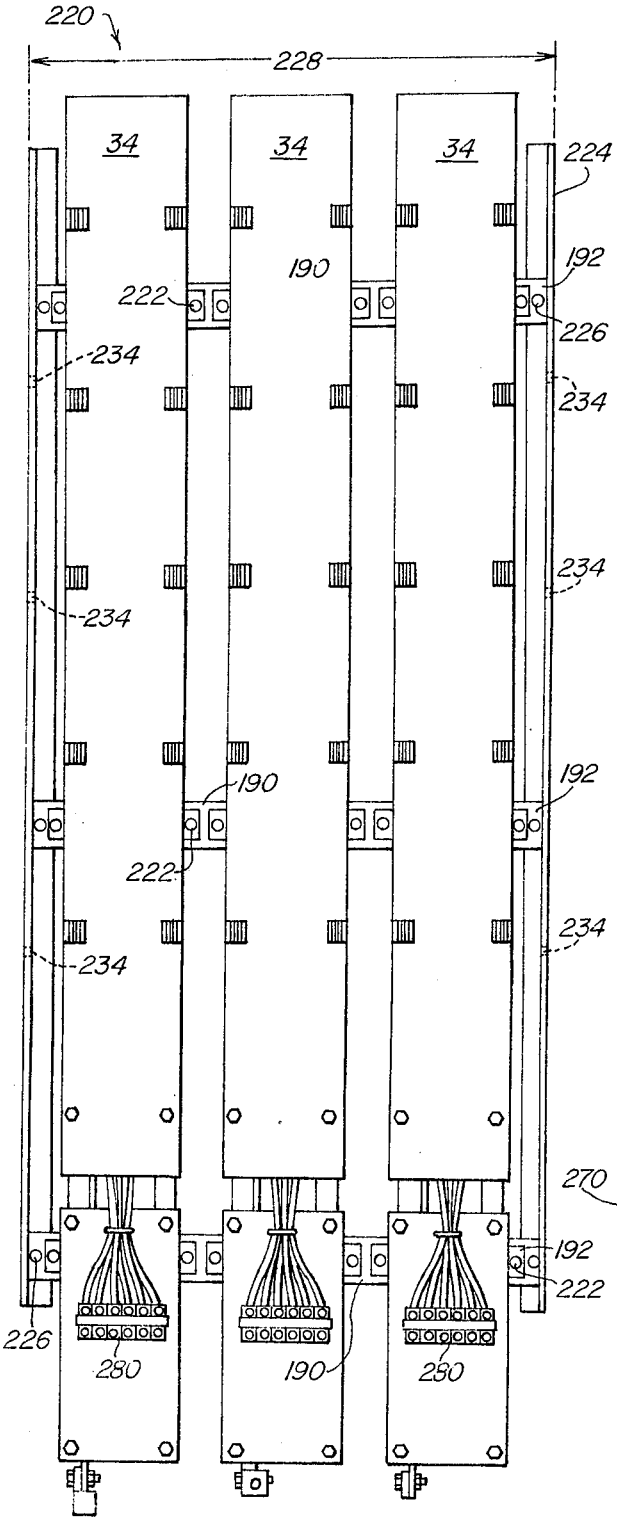
FIG. 16 is a front view of a power bus unit.

As illustrated in FIG. 16, the vertical connector members 34 are preferably assembled into a power bus unit 220. The power bus unit 220 is assembled prior to installation in the chassis 194 of unit I. Mounting tabs 190 provide for attachment to cross supports 192 by removable securing means 222 which are preferably a conventional nut and bolt arrangement. The cross supports 192 are secured to vertical supports 224 by removable securing means 226. The cross supports 192 and vertical supports 224 are dimensioned so that the total horizontal dimension 228 is just slightly less than inside horizontal dimension 230 of chassis 194 (FIG. 2). With such dimensions, the power bus unit 220 can be easily and simply positioned within the chassis 194 and fastened thereto by a nut and bolt arrangement through appertures 231 formed in the side 232 of chassis 194 (FIG. 3) and apertures 234 formed in the vertical supports 224 (FIG. 16).

As hereinabove stated the power bus unit 220 is assembled prior to installation in chassis 194. That is, the vertical connector member 34, vertical insulating member 80, filter reactors 78, power bus 76, connectors 52, 54 (FIG. 5), 204 (FIG. 15), and related components are assembled and mounted together outside the chassis 194 on, for example, a work bench or assembly line.

Prewiring is also accomplished during such assembly. That is, all required conductors are positioned and connected to their appropriate connectors and terminals. For example conductors 86, 88, 94 and 96 (FIG. 5) are positioned in the unit and connected to connectors 52, 54 (FIG. 5) and to terminal boards 198 (FIG. 15). Such preassembly is highly preferred because assembly is faster, easier and in turn more efficient and less costly. The result is a preassembled unit 220 which is easily and readily installed in the chassis 194. Replacement of the entire unit 220 or separate vertical connector members 34 for maintenance is also facilitated at lower cost.

Because the vertical connector member 34 is easily removable, several types may be used interchangably. That is, a different member 34 having different components attached thereto may be provided to be specifically adaptable to one of the drawers 112 or 160. The member 34 illustrated in FIG. 15 shows the connectors 204 needed to connect with connectors 164 and 168 (FIG. 11) of drawer 160. Vertical connector members 34 having connector arrangements for drawer 30 and 112 are substantially identical except for the number and arrangement of connectors and the number of filter reactors mounted to it.

Preferably, a premanufactured connector member 34 is constructed to accommodate only one size (KVA rated) drawer 30, 112 or 160 in its six matrix positions. However, it may be desirable to supply a member 34 having connector arrangements for all available drawers. That is, connectors may be provided in each matrix position so that each of drawers 30, 112 and 160 may be installed. To preclude the possibility of forcing a drawer 30 into an improper matrix position, the connectors (e.g., connectors 52, 54 and 204) on vertical connector member 34 and the connectors (e.g., connectors 44, 46, 48 and 50) on support member 38 are physically positioned so that it is physically impossible to electrically connect an improperly sized drawer 30.

Figure 17:
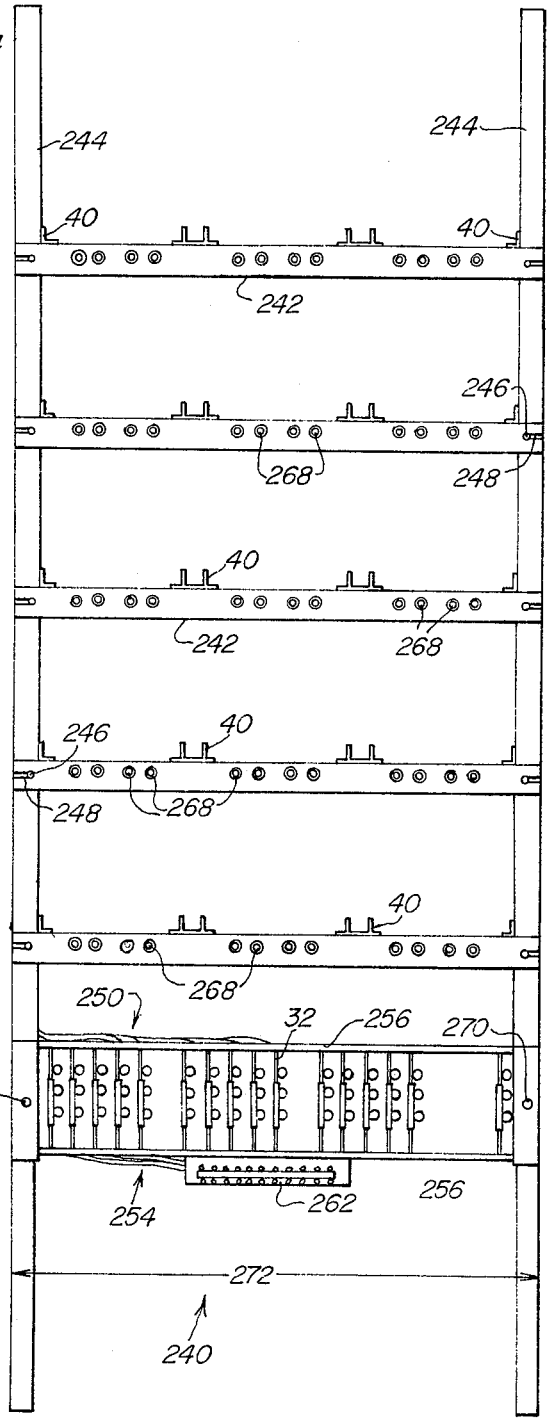
FIG. 17 is a front view of an equipment rack.
Figure 18:
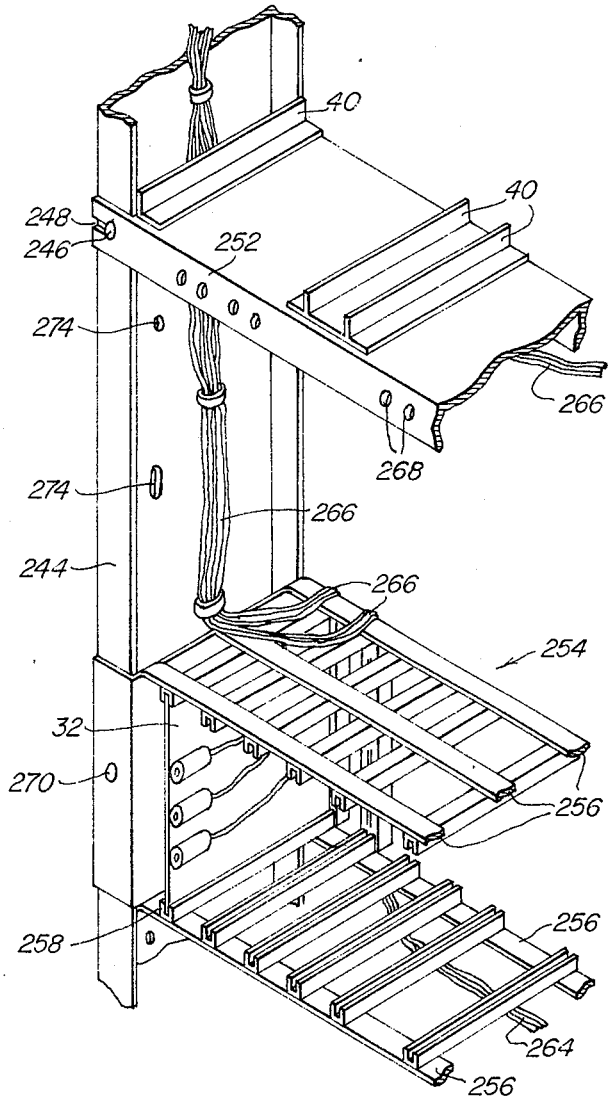
FIG. 18 is a partial perspective view of the equipment rack of FIG. 17.

FIGS. 17 and 18 depict a unitized and preassembled equipment rack 240 for positioning in the chassis 194. The rack 240 provides structural support for drawers 30 and boards 32 along with necessary interconnecting wiring. The rack 240 includes support members 242 which are secured at their opposite ends to the vertical mounting members 244 by mounting means. The mounting means as here illustrated is a conventional nut and bolt 246 positioned through a slot 248 in the support member 242 and an aperture in the vertical mounting member 244. The support members 242 are comparable to the support members 38 hereinbefore illustrated (FIG. 3) and described, differing only with respect to cross sectional projection. Guide pieces 40 are secured to the support members 242 to guide and fix the position of drawers 30.

A circuit board housing assembly 254 is also included in the preassembled equipment rack 240. It includes support members 256, circuit board guides 258 and circuit board connectors 260 which are assembled to accept control circuit boards 32. A terminal point unit 262 is secured to the support members 256. Conductors 264 interconnect the board connectors 260 with the terminal point unit 262. Conductors 266 interconnect the board connectors 260 with drawer connectors 268 positioned in the support member 242 as connectors 44, 46, 48 and 50 are positioned in support member 38 (FIG. 5). The conductors 266 are assembled into bundles and positioned within and secured to the support members 242 and vertical mounting members 244. The circuit board housing assembly 254 is secured to the vertical mounting member 244 by fastening means which, as illustrated, is a conventional nut and bolt 270 system.

The equipment rack 240 is horizontally dimensioned 272 similar to the power bus unit 220. That is, it is dimensioned to be just slightly less than the inside horizontal dimension 230 of chassis 194 (FIG. 2). With such dimension, the equipment rack 240 can be easily and simply positioned within the chassis 194 and fastened thereto by a nut and bolt system through apertures 272 in the side 232 of the chassis 194 and the apertures 274 in the vertical mounting members 244. Preassembling of the equipment rack 240 may be accomplished on a work bench or assembly line. It is highly preferred because it is simpler, easier and cheaper to use than non-unitized components.

The main power apparatus drawers 30, 112 and 160 are easily adapted for use in non-dim (on-off) circuits. One need only short the gate control signal leads (drawer 30, conductors 98 and 106, FIG. 6; drawer 112, conductors 144 and 150, FIG. 9; drawer 160, conductor 184, FIG. 13) to make a non-dim controller. The circuit breakers act as the on-off switch; and the power/voltage delivered to lamps 14 is identical to the power deliverable at maximum illumination from a dimmed circuit. Shorting of gate leads is simply effected because the connectors (e.g., 44, 46, 184, 132) are readily accessible. Further, electronic control circuit boards 32 need not be provided. Thus a non-dim circuit can be provided with substantial savings in cost and having preferred operational functionability.

The preferred main power unit I as herein described is simple to assemble and install. A conventional cabinet chassis 194 may be manufactured or purchased. The power bus unit 220 and equipment rack 240 are assembled and installed as hereinbefore described. Main power drawers 30 and control circuit cards 32 are also preassembled for simple removable installation. On site installation of the main power unit I may then be effected by connecting control signal inputs to terminal unit 262 (FIG. 17), main power leads to connectors 196 (FIG. 15) and output connectors to lamps 14 at terminals 198 (FIG. 15) 280 (FIG. 16).

Maintenance operations for systems having power units I as above described are quite simple and easy to perform. Specifically if a lighting circuit will not dim properly suggesting a failure, drawers 30 and cards 32 from properly operating circuits may simply be interchanged with the suspect ones to ascertain the source of failure. Since replacement drawers and cards are standardized and pre-manufactured, a replacement drawer or card should be readily available. The cost should be minimal too. Of course, if the failure is in the main power circuitry (bus 76 through thyristors to lamps 14), the circuit breakers 52 may provide an obvious indication of the defect. If a defect has arisen in the interconnecting wiring between any of the components, the connectors and terminals of the cabinet are readily accessible to effect standarized resistance and continuity checks. Should repair be required, the power bus unit 220, vertical connector member 34 or equipment rack 240 are easily and simply removed for repair or replaced.

It is to be understood that the embodiments of the invention above-described are merely illustrative of the application of the principles of the invention. Reference herein to details of the illustrated embodiment is not intended to limit the scope of the claims which themselves recite those features regarded as essential to the invention.

I claim:

1. A main power unit for use in a theater lighting system which regulates the luminescence of incandescent lamps, comprising:

a chassis having a first section and a second section remote from said first section;

a plurality of substantially parallel bus bars positioned within said chassis and adjacent said first section and secured to said chassis, each said bus bar being conductively connected to an external source of main power and having a plurality of spaced apart main power connectors positioned along their lengths to form a matrix of bus bar connection sites;

a plurality of drawers slidably and removable positioned in said first section of said chassis and grouped in rows to correspond with said bus bar connection sites, each of said drawers having a main power apparatus positioned therein, a drawer input connector conductively connected to said main power apparatus for connection with a said main power connector, a drawer output connector conductively connected to said main power apparatus, and a control signal input connector conductively connected to said main power apparatus;

equipment rack means having a plurality of substantially parallel support members secured to said chassis and positioned within said first section of said chassis to support said drawers, each said support member having control connectors positioned along their lengths to correspond with and connect to said control signal input connectors of said drawers;

a plurality of output means conductively connected to said drawer output connectors and to said incandescent lamps; and a plurality of control circuits positioned in said second section of said chassis, each of said circuits being conductively connected to receive control signals from an external source and to supply control signals to said support member control connectors.

2. The main power unit of claim 1 wherein each said bus bar is secured to electrical insulator means extending substantially along the entire length of said bus bar.

3. The main power unit of claim 2 wherein said electrical insulator means is secured to a vertical connector member extending substantially along the length of said electrical insulator means, each said vertical connector member having spaced-apart output connectors along its length to correspond with and connect to said drawer output connectors, and each of said spaced-apart output connectors being conductively connected to an output terminal positioned at one end of said vertical connector member for connection to an external circuit.

4. The main power unit of claim 3 wherein each said vertical connector member is secured to horizontal support members to form a unitized power bus unit removably secured within said chassis.

5. The main power unit of claim 1 wherein said equipment rack means extends between said first section and said second section of said chassis, said control circuit means are electronic circuit boards removably positioned in a circuit board housing which is secured to said equipment rack means in second section of said chassis, and said control circuits are conductively connected to supply said control signals to said support member control connectors by conductors positioned adjacent said support members and interconnecting said support member control connectors with circuit board connectors for said circuit boards in said circuit board housing.

6. The main power unit of claim 5 wherein said support members and said circuit board housing have opposite ends secured respectively to two opposite and substantially parallel support members to form a unitized equipment rack removably secured within said chassis.

7. The main power unit of claim 1 wherein each said drawer includes:

two substantially parallel, electrically and thermally conductive side wall members, one said side wall member carrying said drawer input connector and the other said side wall member carrying said drawer output connector;

front panel means electrically insulated from and secured to said side wall members; and a thyristor secured to each said side wall member.

8. The main power unit of claim 7 wherein said side wall members are comprised of a vane base and a plurality of vanes which extend away from said vane base to constitute heat transfer means, and said drawer has an open top and bottom so that air may flow therethrough.

9. The main power unit of claim 8 wherein each said drawer includes electrical overload protection means in electrical circuit with said main power apparatus.

10. The main power unit of claim 9 wherein said electrical overload protection means is an electrical circuit breaker secured to said front panel of said drawer.

11. The main power unit of claim 10 wherein said main power apparatus in said drawer includes two thyristors each having gate control leads which when shorted together provide on-off full illumination control for said incandescent lamps by operation of said electrical circuit breaker.

12. The main power unit of claim 11 wherein said first section is spaced vertically above said second section.

13. The main power unit of claim 1 wherein each said drawer has four said main power apparatus and includes:

two substantially parallel, electrically and thermally conductive side wall members each divided into two substantially parallel and symmetric halves, each said half being electrically insulated from the other, each formed to be alternately and selectively said drawer input and output connectors, and four thyristors, one secured to each of said halves; and front panel means electrically insulated from and secured to said side wall members.

* * * * *